US010808901B2

(12) United States Patent
Jung et al.

(10) Patent No.: US 10,808,901 B2
(45) Date of Patent: Oct. 20, 2020

(54) CAR LAMP USING HALF MIRROR AND SEMICONDUCTOR LIGHT EMITTING DEVICE

(71) Applicant: ZKW Group GmbH, Wieselburg (AT)

(72) Inventors: Mongkwon Jung, Seoul (KR); Joongtaek Cha, Seoul (KR)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/512,925

(22) Filed: Jul. 16, 2019

(65) Prior Publication Data

US 2020/0025347 A1 Jan. 23, 2020

(30) Foreign Application Priority Data

Jul. 17, 2018 (KR) ..... 10-2018-0083056

(51) Int. Cl.

| | |
|---|---|
| ***F21S 41/365*** | (2018.01) |
| ***F21S 43/14*** | (2018.01) |
| ***F21S 41/19*** | (2018.01) |
| ***F21S 43/31*** | (2018.01) |
| ***F21S 41/145*** | (2018.01) |
| ***F21S 41/20*** | (2018.01) |
| ***F21S 43/19*** | (2018.01) |

(52) U.S. Cl.

CPC ..... *F21S 41/365* (2018.01); *F21S 41/145* (2018.01); *F21S 41/192* (2018.01); *F21S 41/285* (2018.01); *F21S 43/14* (2018.01); *F21S 43/195* (2018.01); *F21S 43/31* (2018.01)

(58) Field of Classification Search

CPC ..... F21S 41/365; F21S 41/645

See application file for complete search history.

(56) References Cited

U.S. PATENT DOCUMENTS

2009/0002822 A1* 1/2009 Tonar ..... B60R 1/088 359/488.01
2015/0345740 A1* 12/2015 Watanabe ..... F21S 43/30 362/517

FOREIGN PATENT DOCUMENTS

| | | |
|---|---|---|
| DE | 102015210288 | 12/2015 |
| EP | 2905530 | 8/2015 |
| FR | 3055690 | 3/2018 |

(Continued)

OTHER PUBLICATIONS

Extended European Search Report in European Application No. 19185937.0, dated Sep. 19, 2019, 11 pages.

*Primary Examiner* — Evan P Dzierzynski
*Assistant Examiner* — Keith G. Delahoussaye
(74) *Attorney, Agent, or Firm* — Fish & Richardson P.C.

(57) ABSTRACT

The present invention relates to a lamp, including a half mirror having upper and lower surfaces to reflect a part of light incident on the lower surface and discharge another part to outside, a first reflector located below the half mirror to be vertically spaced so as to face the lower surface of the half mirror, a plurality of light sources to emit light between the half mirror and the first reflector, and a second reflector located between the light sources to reflect at least some of incident light, wherein the half mirror and the second reflector face each other, such that light emitted from a part of the light sources is repeatedly reflected between the half mirror and the second reflector, and wherein the first and second reflectors face each other, such that light emitted from the remaining light source is repeatedly reflected between the first and second reflectors.

11 Claims, 5 Drawing Sheets

(56) References Cited

FOREIGN PATENT DOCUMENTS

| | | |
|---|---|---|
| JP | 2013214492 | 10/2013 |
| JP | 2015179603 | 10/2015 |
| JP | 2017197146 | 11/2017 |
| JP | 2018032510 | 3/2018 |
| KR | 100775844 | 11/2007 |
| KR | 1020100092745 | 8/2010 |
| KR | 20140090293 | 7/2014 |
| KR | 1020140090293 | 7/2014 |
| KR | 20150053573 | 5/2015 |
| WO | WO2016005339 | 1/2016 |

* cited by examiner

CAR LAMP USING HALF MIRROR AND SEMICONDUCTOR LIGHT EMITTING DEVICE

CROSS-REFERENCE TO RELATED APPLICATION

Pursuant to 35 U.S.C. § 119(a), this application claims the benefit of an earlier filing date of and the right of priority to Korean Application No. 10-2018-0083056, filed on Jul. 17, 2018, the contents of which are incorporated by reference herein in its entirety.

FIELD

The present invention relates to a car lamp (or vehicle lamp) and a control method thereof, and more particularly, a vehicle lamp using a semiconductor light emitting device.

BACKGROUND

A vehicle or car is equipped with various lamps having lighting functions and signaling functions. In general, halogen lamps or gas discharge lamps are usually used, but in recent years, light emitting diodes (LEDs) are in the spotlight as light sources for vehicle lamps.

The LED can enhance a degree of freedom for design of a lamp by minimizing a size thereof and exhibit economic efficiency by virtue of a semi-permanent lifespan, but most of the LEDs are currently produced in a form of a package. The LED itself other than the package is a semiconductor light emitting device of converting a current into light and is under development as an image displaying light source equipped in an electronic device such as an information communication device.

In recent years, attempts have been made to vary an illumination (lighting) pattern of a lamp as the size of the semiconductor light emitting device decreases. However, in order to realize various illumination patterns, structures in addition to a light source are required, which causes an increase in the size of the lamp, a decrease in brightness, and the like. As a result, various implementations of the illumination pattern of the lamp are limited.

SUMMARY

One aspect of the present invention is to provide a lamp capable of realizing a stereoscopic illumination pattern while maintaining a slim thickness thereof.

Another aspect of the present invention is to provide a lamp capable of implementing various illumination patterns.

To achieve the aspects and other advantages of the present invention, there is provided a lamp, including a half mirror having an upper surface and a lower surface, and configured to reflect a part of light incident on the lower surface and discharge another part to outside, a first reflector located below the half mirror in a spaced manner in a vertical direction so as to face the lower surface of the half mirror, a plurality of light sources to emit light to a space between the half mirror and the first reflector, and a second reflector located between the light sources to reflect at least some of incident light, wherein the half mirror and the second reflector are arranged to face each other, such that light emitted from a part of the light sources is repeatedly reflected between the half mirror and the second reflector, and wherein the first and second reflectors are located to face each other, such that light emitted from the remaining part of the light sources is repeatedly reflected between the first and second reflectors.

In one embodiment, the second reflector may overlap a portion of the half mirror at one end of the half mirror.

In one embodiment, the light source may include a first light source located above the second reflector, and a second light source located below the second reflector.

In one embodiment, a vertical distance between the first light source and the second reflector may be different from a vertical distance between the second light source and the second reflector.

In one embodiment, a vertical distance between the half mirror and the second reflector may be different from a vertical distance between the first reflector and the second reflector.

In one embodiment, at least a part of the second reflector may be formed as a half mirror.

In one embodiment, a vertical distance between the half mirror and the second reflector may be different from a vertical distance between the first reflector and the second reflector.

In one embodiment, the lamp may further include an electrochromic layer covering at least a part of the second reflector and having light transmittance that changes as a current or voltage is applied.

In one embodiment, the second reflector may be located to be tilted at a predetermined angle with respect to the half mirror.

In one embodiment, the second reflector may be provided in plurality, and the plurality of second reflectors may be located with being spaced apart from one another along one direction.

In one embodiment, the plurality of second reflectors may be spaced apart from one another along a direction that the lower surface of the half mirror faces, and each of the plurality of light sources may be located between the neighboring second reflectors of the plurality of second reflectors.

In one embodiment, areas that the plurality of second reflectors overlaps the half mirror, respectively, may be different from one another.

In one embodiment, the plurality of second reflectors may be located with being spaced apart from one another in parallel with the lower surface of the half mirror, and have an overlapping area with the half mirror decreased as a distance from the light sources increases.

In one embodiment, the lamp may further include a controller to receive a control command generated during driving of the vehicle, and to control the light sources to be lighted on or off based on the control command.

In one embodiment, when receiving the control command while only a light source located at one of upper and lower sides of the second reflector is turned on, the controller may light on a light source located at another side of the upper and lower sides, such that a quantity of light emitted to a specific region of the half mirror increases.

EFFECTS OF THE DISCLOSURE

According to the present invention, it is not necessary to arrange light sources three-dimensionally in order to realize a stereoscopic illumination pattern. Accordingly, the present invention can realize the stereoscopic illumination pattern while maintaining a slim thickness of the lamp.

Further, according to the present invention, it is possible to change an illumination pattern by selectively lighting on or off light sources, so that a plurality of functions can be realized by a single light source.

DETAILED DESCRIPTION OF THE PREFERRED EMBODIMENT

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present invention is not limited by the accompanying drawings.

It will be understood that when an element such as a layer, area or substrate is referred to as being "on" another element, it can be directly on the element, or one or more intervening elements may also be present.

A vehicle lamp described in this specification may include a head lamp, a tail lamp, a position lamp, a fog lamp, a turn signal lamp, a brake lamp, an emergency lamp, a backup lamp, and the like. However, it will be readily apparent to those skilled in the art that the configuration according to the embodiments described herein may also be applied to a new product type that will be developed later if the device is a device capable of emitting light.

Figure 1:
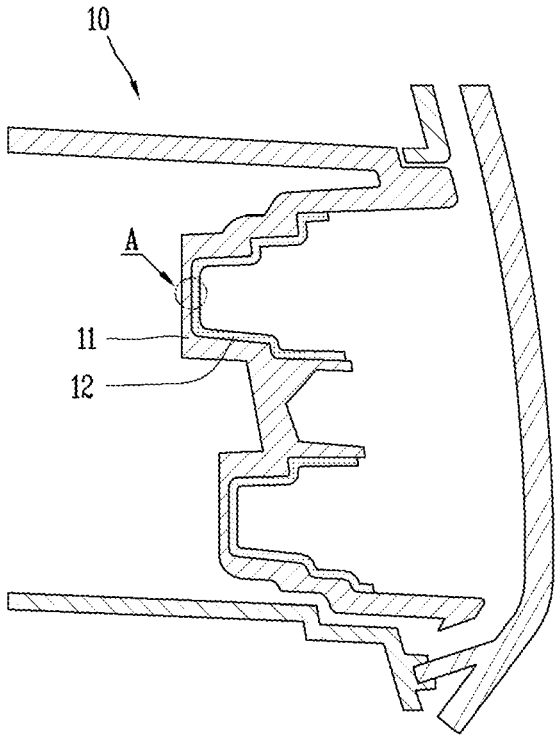
FIG. 1 is a conceptual view illustrating one embodiment of a lamp for a vehicle (a car lamp or a vehicle lamp) using a semiconductor light emitting device according to the present invention.

FIG. 1 is a conceptual view illustrating one embodiment of a lamp for a vehicle (or a vehicle lamp) using a semiconductor light emitting device according to the present invention.

A vehicle lamp 10 according to one embodiment of the present invention includes a frame 11 fixed to a vehicle body, and a light source unit 12 installed on the frame 11.

A wiring line for supplying power to the light source unit 12 may be connected to the frame 11, and the frame 11 may be fixed to the vehicle body directly or by using a bracket. According to the present invention, the vehicle lamp 10 may be provided with a lens unit to more diffuse and sharpen light emitted from the light source unit 12.

The light source unit 12 may be a flexible light source unit that can be curved, bent, twisted, folded, or rolled by external force.

In a non-curved state of the light source unit 12 (for example, a state having an infinite radius of curvature, hereinafter, referred to as a first state), the light source unit 12 is flat. When the first state is switched to a state that the light source unit 12 is bent by an external force (e.g., a state having a finite radius of curvature, hereinafter, referred to as a second state), the flexible light source unit may have a curved surface with at least part curved or bent.

A pixel of the light source unit 12 may be implemented by a semiconductor light emitting device. The present invention exemplarily illustrates a light emitting diode (LED) as a type of semiconductor light emitting device for converting current into light. The LED may be a light emitting device having a small size, and may thus serve as a pixel even in the second state.

Figure 2:
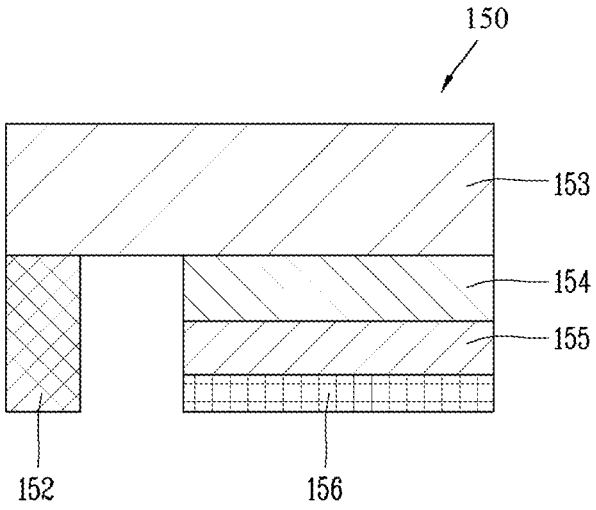
FIG. 2 is a conceptual view illustrating a flip chip type semiconductor light emitting device.
Figure 3:
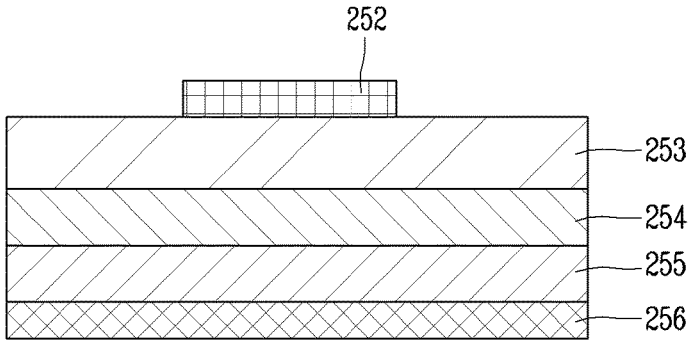
FIG. 3 is a conceptual view illustrating a vertical type semiconductor light emitting device.

FIG. 2 is a conceptual view illustrating a flip chip type semiconductor light emitting device, and FIG. 3 is a conceptual view illustrating a vertical type semiconductor light emitting device.

Since the semiconductor light emitting device 150 has excellent brightness, it can constitute an individual unit pixel even though it has a small size. The individual semiconductor light emitting device 150 may have a size of 80 μm or less on one side, and may be a rectangular or square device. In this case, an area of the single semiconductor light emitting device is in the range of 10-10 to 10-5 m2, and an interval between light emitting devices may be in the range of 100 um to 10 mm.

Referring to FIG. 2, the semiconductor light emitting device 150 may be a flip chip type light emitting device.

For example, the semiconductor light emitting device includes a p-type electrode 156, a p-type semiconductor layer 155 on which the p-type electrode 156 is formed, an active layer 154 located on the p-type semiconductor layer 155, an n-type electrode 153 located on the active layer 154, and an n-type electrode 152 located on the n-type semiconductor layer 153 with being spaced apart from the p-type electrode 156 in a horizontal direction.

Alternatively, the semiconductor light emitting device 250 may have a vertical structure.

Referring to FIG. 3, the vertical type semiconductor light emitting device includes a p-type electrode 256, a p-type semiconductor layer 255 formed on the p-type electrode 256, an active layer 254 formed on the p-type semiconductor layer 255, an n-type semiconductor layer 253 formed on the active layer 254, and an n-type electrode 252 formed on the n-type semiconductor layer 253.

In addition, the plurality of semiconductor light emitting devices 250 constitute a light emitting device array and an insulating layer is interposed between the plurality of light emitting devices. However, the present invention is not necessarily limited thereto, and but alternatively employs a structure in which an adhesive layer fully fills a gap between the semiconductor light emitting devices without the insulating layer.

The insulating layer may be a transparent insulating layer including silicon oxide (SiOx) or the like. As another example, the insulating layer may be formed of epoxy having excellent insulation characteristic and low light absorption, a polymer material such as methyl, phenyl-based silicone and the like, or an inorganic material such as SiN, Al2O3 and the like, in order to prevent shorting between electrodes.

Although the embodiments of the semiconductor light emitting device have been described above, the present invention is not limited to the semiconductor light emitting device but may be alternately realized through various semiconductor light emitting devices.

The lamp according to the present invention realizes a stereoscopic illumination pattern and can give various functions to a single lamp by changing the illumination pattern.

Figure 4:
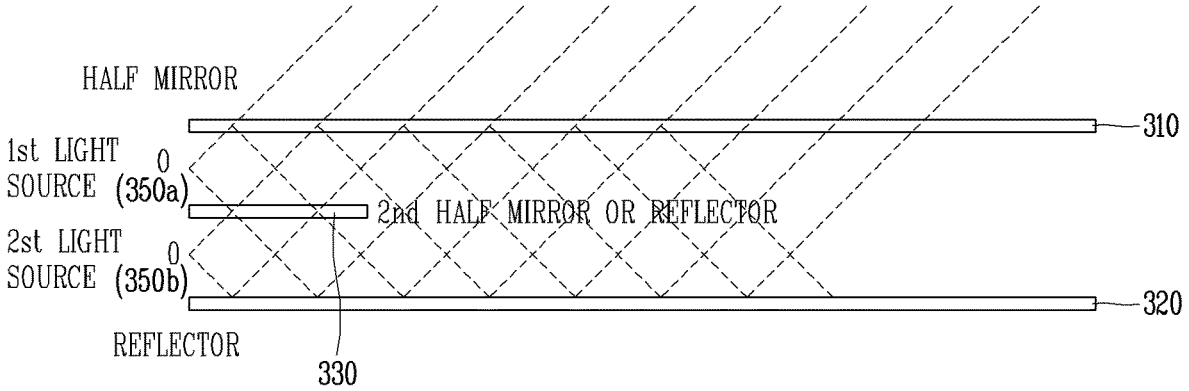
FIG. 4 is a conceptual view illustrating a cross section of a lamp according to the present invention.

FIG. 4 is a conceptual view illustrating a cross section of a lamp according to the present invention.

Referring to FIG. 4, the lamp according to the present invention may include a half mirror 310, a first reflector 320, a second reflector 330, and a plurality of light sources 350. Hereinafter, each of the constituent elements and a coupling relationship between the constituent elements will be described.

The half mirror 310 reflects a part of light incident on the lower surface and another part is discharged to the outside. For example, the half mirror 310 may reflect 50% of the light incident on the lower surface and transmit the remaining light therethrough. Reflectance or transmittance of the half mirror 310 may vary depending on a material of the half mirror 310.

Meanwhile, the half mirror 310 is not necessarily located at the outermost portion of the lamp according to the present invention. Light passing through the upper surface of the half mirror 310 may be transmitted to the outside through an additional structure overlapping the upper surface. For example, the lamp according to the present invention may include a lens, a protective layer, and the like which overlap the upper surface of the half mirror 310 and are located at an outer side than the half mirror 310. However, since these additional configurations are well known in the art, a detailed description thereof will be omitted.

Although only the half mirror 310 and components located inside the half mirror 310 are described herein, the present invention does not exclude that additional components are located outside the half mirror 310.

The first reflector 320 is located below the half mirror 310 and is located to face the lower surface of the half mirror 310. The light reflected by the first reflector 320 is directed to the lower surface of the half mirror 310. The light reflected from the lower surface of the half mirror 310 is directed to the first reflector 320. The light which is incident between the first reflector 320 and the half mirror 310 may be repeatedly reflected between the half mirror 310 and the first reflector 320.

Meanwhile, the second reflector 330 reflects at least some of incident light. The second reflector 330 is located between the plurality of light sources 350 which emit light to a space between the half mirror 310 and the first reflector 320.

One surface of the half mirror 310 and one surface of the second reflector 330 are located to face each other and one surface of the first reflector 320 and another surface of the second reflector 330 are located to face each other.

The second reflector 330 may reflect all of incident light or may transmit some of the incident light therethrough, like the half mirror 310. A part of the light sources 350 is located to emit light to a space between the half mirror 310 and the second reflector 330, and the remaining light source 350 is located to emit light to a space between the first reflector 320 and the second reflector 330.

For this, the second reflector 330 is located between the plurality of light sources 350. In one embodiment, the light sources may include a first light source 350*a* and a second light source 350*b*. The second reflector 330 may be located between the first light source 350*a* and the second light source 350*b*.

On the other hand, the light sources are located up and down with the second reflector 330 interposed therebetween. In this specification, an upper side of the second reflector 330 is defined as a direction toward the half mirror 310, and a lower side of the second reflector 330 is defined as a direction toward the first reflector 320.

The second reflector 330 may be located to overlap a portion of the half mirror 310 at one end portion of the half mirror 310. That is, the second reflector 330 may be located only around a side surface of the lamp where the light sources are arranged, without overlapping the entire half mirror 310.

Accordingly, light which is incident between the half mirror 310 and the second reflector 330 is repeatedly reflected between the half mirror 310 and the second reflector 330, discharged out of the space between the half mirror 310 and the second reflector 330, and then repeatedly reflected between the half mirror 310 and the first reflector 320.

On the other hand, light which is incident between the first reflector 320 and the second reflector 330 is repeatedly reflected between the first reflector 320 and the second reflector 330, discharged out of the space between the first reflector 320 and the second reflector 330, and then repeatedly reflected between the half mirror 310 and the first reflector 320.

According to the structure, since an optical path of the light incident between the half mirror 310 and the second reflector 330 and an optical path of the light incident between the first reflector 320 and the second reflector 330 differ from each other, a stereoscopic illumination pattern is generated On the other hand, the illumination pattern may be largely divided into two regions. First, one region is a region which is formed as the light is concentrated thereon. The illumination pattern of the lamp according to the present invention is generated by overlapping illumination patterns generated respectively by the plurality of light sources. Accordingly, such light-concentrated region may be formed. In this specification, a region which is relatively bright due to light being concentrated thereon as described above is referred to as a first region. The first region may be plural.

Second, another region is a region formed around the first region. The second region is darker than the first region, but gives a three-dimensional feeling. Actually, the first and second regions may not be clearly distinguished by the naked eye. In this specification, for convenience of description, a relatively bright region is referred to as the first region, and a region formed around the first region is referred to as the second region.

Figure 5A:
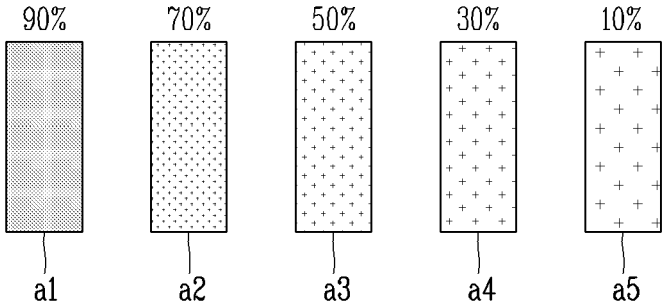
FIGS. 5A and 5B are conceptual views illustrating an illumination pattern of a lamp according to the present invention.

Referring to FIG. 5A, an illumination pattern may include a plurality of first regions a1 to a5. Although not shown in FIG. 5A, a three-dimensional pattern is generated around the first regions a1 to a5. Brightness of the first region may decrease (e.g., from 90% to 10%) in one direction. Such an illumination pattern can be utilized as a tail lamp of a vehicle.

Figure 5B:
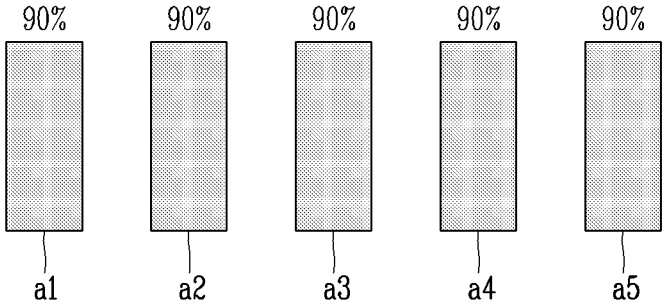

On the other hand, as shown in FIG. 5B, the plurality of first regions a1 to a5 may have constant brightness. Since the pattern according to FIG. 5B is brighter than that of FIG. 5A, it can be utilized as a brake lamp.

A size, interval, and shape of the first region may change according to a method of arranging the half mirror 310, the first reflector 320, the second reflector 330, and the light sources 350, and the stereoscopic shape of the second region may vary. Hereinafter, various embodiments of arranging the half mirror 310, the first reflector 320, the second reflector 330, and the light sources 350 will be described.

Figure 6:
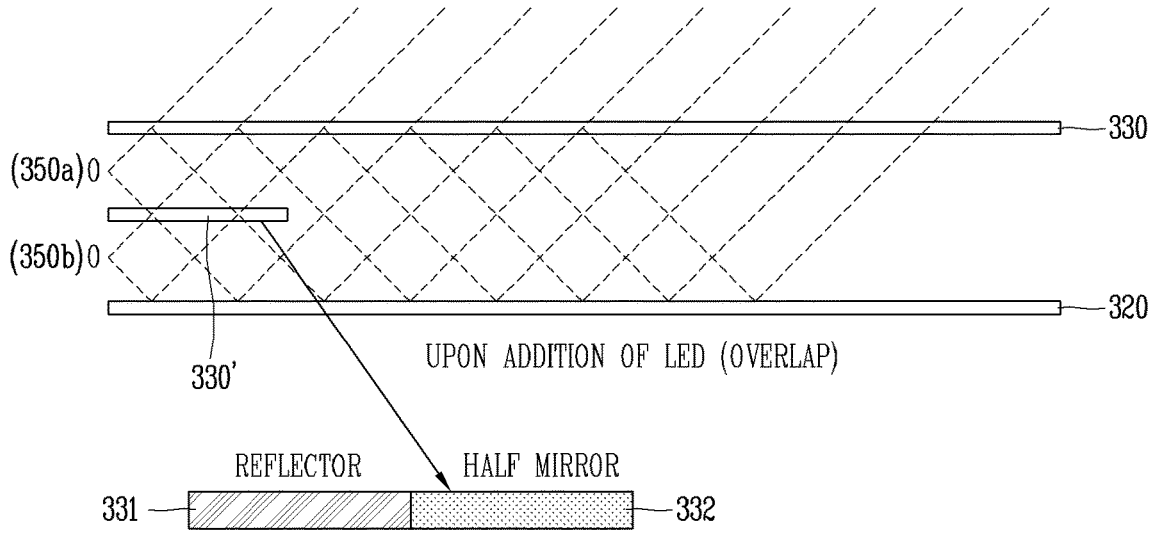
FIG. 6 is a conceptual view illustrating a cross section of a lamp including a mirror and a reflector combined with a half mirror.
Figure 7:
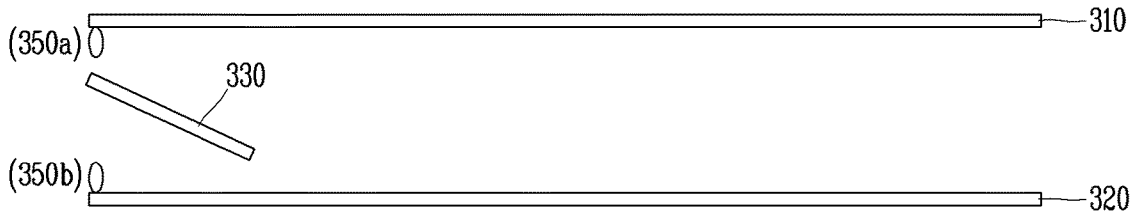
FIG. 7 is a conceptual view illustrating a cross section of a lamp including a tilted reflector.
Figure 8:
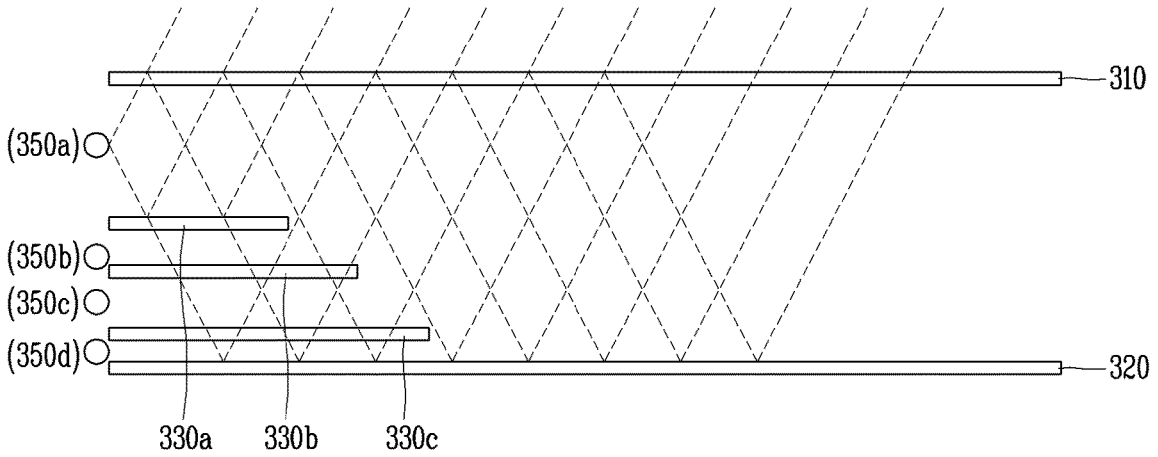
FIGS. 8 to 10 are conceptual views illustrating a cross section of a lamp including a plurality of reflectors.
Figure 9:
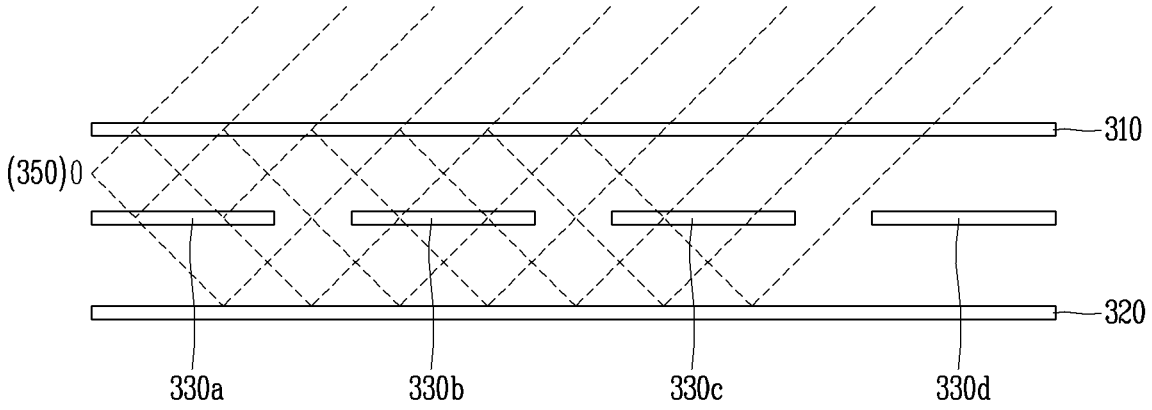
Figure 10:
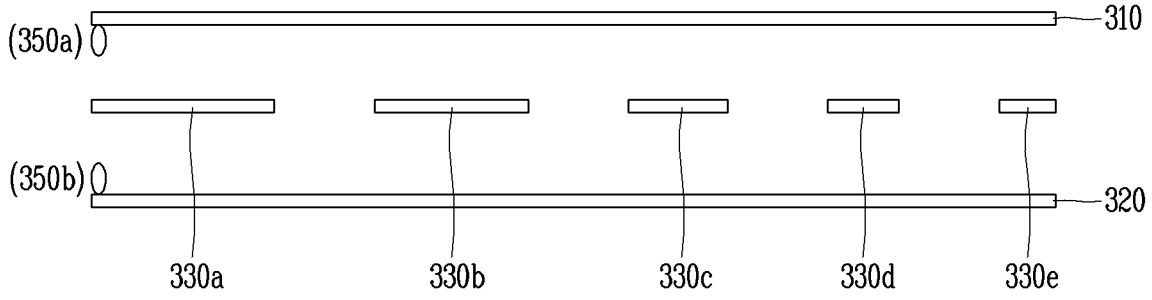

FIG. 6 is a conceptual view illustrating a cross section of a lamp including a mirror and a reflector combined with a half mirror, FIG. 7 is a conceptual view illustrating a cross section of a lamp including a tilted reflector, and FIGS. 8 to 10 are conceptual views illustrating a cross section of a lamp including a plurality of reflectors.

As described above, some of the light sources are located above and below the second reflector 330. In one embodiment, a vertical or perpendicular distance between the light source located above the second reflector 330 and the second reflector 330 and a vertical distance between the light source located below the second reflector 330 and the second reflector 330 may be different from each other. Thus, the present invention can realize various illumination patterns.

In another embodiment, a vertical distance between the half mirror 310 and the second reflector 330 and a vertical distance between the first reflector 320 and the second reflector 330 may be different from each other. An optical path may vary according to the distance between the half mirror 310 and the second reflector 330 and the distance between the first reflector 320 and the second reflector 330 and thus various illumination patterns can be generated.

As described above, the present invention can diversify the illumination pattern by varying the distances between the second reflector 330 and the light sources, the distance between the second reflector 330 and the half mirror 310 and the distance between the second reflector 330 and the first reflector 320.

Meanwhile, the present invention may diversify the illumination pattern through reflectance of the second reflector 330. In detail, at least a part of the second reflector 330 may be configured as a half mirror. According to the structure, a part of light emitted from the light sources is repeatedly reflected between the half mirror 310 and the first reflector 320, another part is repeatedly reflected between the half mirror 310 and the second reflector 330, and the other is repeatedly reflected between the first reflector 320 and the second reflector 330. That is, according to the structure, three different kinds of optical paths can be formed. Thus, the present invention can diversify the illumination pattern.

In one embodiment, as illustrated in FIG. 6, the second reflector 330 may include a first region located adjacent to the light sources, and a second region excluding the first region. Here, the first region may be a mirror that reflects light, and the second region may be the half mirror. The illumination pattern may vary depending on an area ratio between the first and second regions, a position of each region, and reflectance of the half mirror.

In another embodiment, the second reflector 330 may have variable light transmittance. In detail, the second reflector 330 may further include an electrochromic layer having light transmittance that changes as a current or voltage is applied. When the electrochromic layer is stacked on the mirror, it may be utilized as a reflector having variable reflectance. The illumination pattern may vary depending on the reflectance of the second reflector 330. In order to apply a current or voltage to the electrochromic layer, the lamp according to the present invention may further include a power supply unit. By utilizing the electrochromic layer, the illumination pattern can be changed by varying the current or voltage applied to the electrochromic layer, without changing a physical structure.

Meanwhile, as illustrated in FIG. 7, the second reflector 330 may be located to be tilted at a predetermined angle with respect to the half mirror 310. When the second reflector 330 is tilted, an optical path to the light source located above the second reflector 330 and an optical path to the light source located below the second reflector 330 may differ.

In one embodiment, the lamp according to the present invention may further include a tilting portion for adjusting the tilted angle of the second reflector 330. The tilting portion may change the tilted angle of the second reflector 330 so as to vary the illumination pattern.

Meanwhile, the second reflector 330 may be provided in plurality. In detail, the plurality of second reflectors 330 may be spaced apart from each other in a direction parallel to the half mirror 310, or may be spaced apart from each other in a direction toward the lower surface of the half mirror 310.

In one embodiment, as illustrated in FIG. 8, a plurality of second reflectors 330*a* to 330*c* may be located along a direction in which the lower surface of the half mirror 310 faces. That is, the plurality of second reflectors may be arranged in a thickness direction of the lamp. Here, overlapping areas of the second reflectors with the half mirror 310 may sequentially change. Meanwhile, light sources 350*a* to 350*d* may be located between the neighboring second reflectors 330*a* to 330*c*. Accordingly, light emitted from some of the light sources may be repeatedly reflected between the neighboring second reflectors 330*a* to 330*c*.

In another embodiment, the plurality of second reflectors may serve to concentrate light onto the half mirror. In particular, as a distance from the light source unit increases, a quantity of light incident on the half mirror may be reduced. Here, the second reflectors may increase the quantity of light directed toward the half mirror. In particular, as illustrated in FIG. 9, when the second reflectors are located to be spaced apart from one another in a direction parallel to the half mirror 310, brightness of the illumination pattern formed at a far distance from the light source can be increased.

On the other hand, as illustrated in FIG. 10, when the second reflectors are spaced apart from one another in a direction parallel to the half mirror 310, the overlapping areas of the second reflectors with the half mirror 310 may be sequentially increased or decreased. When the second reflectors are spaced apart from one another in the direction parallel to the half mirror 310, light may be concentrated on positions adjacent to the second reflectors, and first regions of the illumination pattern may be formed at the positions adjacent to the second reflectors. When the areas of the second reflectors are sequentially changed, an illumination pattern in which the areas of the first regions are sequentially changed may be formed.

As described above, the present invention can form various illumination patterns using the half mirror 310, the first reflector 320, the second reflector 330, and the plurality of light sources 350. Meanwhile, the present invention may change the illumination pattern so as to realize a plurality of functions in a single lamp.

For example, when the lamp according to the present invention is applied to a vehicle, the lamp according to the present invention can be used as a tail lamp and simultaneously used as a brake lamp.

To this end, the present invention may further include a controller (or a control unit) for controlling each of the light sources to be turned on or off. Specifically, the controller included in the lamp receives a control command generated while the vehicle is driven, and controls the light sources to be lighted on or off based on the received control command.

Here, the control command may be generated by a sensing result of a sensing unit provided in the vehicle or a user input applied through an interface unit.

The sensing unit may sense a status of the vehicle. The sensing unit may include a posture sensor (e.g., a yaw sensor, a roll sensor, a pitch sensor, etc.), a collision sensor, a wheel sensor, a speed sensor, a tilt sensor, a weight-detecting sensor, a heading sensor, a gyro sensor, a position module, a vehicle forward/backward movement sensor, a battery sensor, a fuel sensor, a tire sensor, a steering sensor by a turn of a handle, a vehicle internal temperature sensor, a vehicle internal humidity sensor, an ultrasonic sensor, an illumination sensor, an accelerator position sensor, a brake pedal position sensor, and the like.

The sensing unit may acquire sensing signals with respect to vehicle-related information, such as a posture, a collision, an orientation, a position (GPS information), an angle, a speed, an acceleration, a tilt, a forward/backward movement, a battery, a fuel, tires, lamps, internal temperature, internal humidity, a rotated angle of a steering wheel, external illumination, pressure applied to an accelerator, pressure applied to a brake pedal and the like.

The sensing unit may further include an accelerator sensor, a pressure sensor, an engine speed sensor, an air flow sensor (AFS), an air temperature sensor (ATS), a water temperature sensor (WTS), a throttle position sensor (TPS), a TDC sensor, a crank angle sensor (CAS), and the like.

The interface unit may serve as a path allowing the vehicle to interface with various types of external devices connected thereto. For example, the interface unit may be provided with a port connectable with a mobile terminal, and connected to the mobile terminal through the port. In this instance, the interface unit may exchange data with the mobile terminal.

The controller located in the vehicle may generate a control command for controlling the lamp based on a sensing result of the sensing unit or a user input applied through the interface unit.

In one embodiment, the controller located in the vehicle may generate a control command for controlling the lamp based on a sensing result of pressure applied to a brake pedal. Specifically, when pressure applied to the brake pedal increases, the controller located in the vehicle may generate a control command for turning on the brake lamp, and transmit the generated control command to the controller.

The controller located in the lamp may receive the control command and change an illumination pattern corresponding to a tail lamp to an illumination pattern corresponding to a brake lamp.

In one embodiment, the controller located in the lamp may turn on a part of the light sources when the illumination pattern corresponding to the tail lamp is realized. In this case, as illustrated in FIG. 5A, an illumination pattern may be formed in which brightness of each first region is sequentially decreased along one direction. When the controller located in the lamp receives a control command related to the brake lamp, the controller located in the lamp lights up a light source, which has been turned off, such that a quantity of light emitted to a specific region of the half mirror 310 can increase. Accordingly, an illumination pattern in which the brightness of the first regions increases as illustrated in FIG. 5B.

A driver located behind the vehicle can recognize that the speed of the vehicle is being reduced when the illumination pattern changes from FIG. 5A to FIG. 5B. As described above, the present invention can make it possible to utilize a single lamp as the tail lamp and the brake lamp of the vehicle.

Hereinafter, various modified embodiments of the lamp according to the present invention may not be limited to the foregoing embodiments. For example, the present invention may sequentially light on the light sources, such that the lamp can be used as turn signal lamps.

It will be apparent to those skilled in the art that the present invention may be embodied in other specific forms without departing from the spirit or essential characteristics thereof.

Therefore, it should also be understood that the above-described embodiments are not limited by any of the details of the foregoing description, unless otherwise specified, but rather should be construed broadly within its scope as defined in the appended claims, Therefore, all changes and modifications that fall within the metes and bounds of the claims, or equivalents of such metes and bounds are therefore intended to be embraced by the appended claims.

What is claimed is:

1. A lamp, comprising:

a half mirror having an upper surface and a lower surface, and configured to reflect a part of light incident on the lower surface and discharge another part of the light incident on the lower surface therethrough;

a first reflector located below the half mirror in a spaced manner in a vertical direction so as to face the lower surface of the half mirror;

a plurality of light sources configured to emit light to a space between the half mirror and the first reflector; and a second reflector located between the light sources and configured to reflect at least some of incident light, wherein the second reflector overlaps a portion of the half mirror at one end of the half mirror, wherein the half mirror and the second reflector are arranged to face each other, such that light emitted from a part of the plurality of light sources is repeatedly reflected between the half mirror and the second reflector, wherein the first and second reflectors are located to face each other, such that light emitted from the remaining part of the plurality of light sources is repeatedly reflected between the first and second reflectors, wherein the plurality of light sources comprise a first light source located above the second reflector, and a second light source located below the second reflector, and wherein a vertical distance between the first light source and the second reflector is different from a vertical distance between the second light source and the second reflector.

2. The lamp of claim 1, wherein a vertical distance between the half mirror and the second reflector is different from a vertical distance between the first reflector and the second reflector.

3. The lamp of claim 1, wherein at least a part of the second reflector is formed as a half mirror.

4. The lamp of claim 1, further comprising an electrochromic layer covering at least a part of the second reflector and having light transmittance that changes as a current or voltage is applied.

5. The lamp of claim 1, wherein the second reflector is located to be tilted at a predetermined angle with respect to the half mirror.

6. The lamp of claim 1, wherein the second reflector is provided in plurality, and the plurality of second reflectors is located with being spaced apart from one another along one direction.

7. The lamp of claim 6, wherein the plurality of second reflectors is spaced apart from one another along a direction that the lower surface of the half mirror faces, and wherein each of the plurality of light sources is located between adjacent second reflectors among the plurality of second reflectors.

8. The lamp of claim 6, wherein areas that the plurality of second reflectors overlaps the half mirror, respectively, are different from one another.

9. The lamp of claim 8, wherein the plurality of second reflectors is located with being spaced apart from one another in parallel with the lower surface of the half mirror, and each has an overlapping area with the half mirror which is decreased as a distance from the plurality of light sources increases.

10. The lamp of claim 1, further comprising a controller configured to receive a control command generated during driving of a vehicle, and to control one or more of the plurality of light sources to be turned on or turned off based on the control command.

11. The lamp of claim 10, wherein the controller is configured to, based on receiving the control command while only a light source of the plurality of light sources located at one of upper and lower sides of the second reflector is turned on, turn on a light source of the plurality of light sources located at another side of the upper and lower sides of the second reflector such that to thereby increase a quantity of light emitted to a specific region of the half mirror.

* * * * *